US006273636B1

(12) United States Patent
Johanpeter

(10) Patent No.: US 6,273,636 B1
(45) Date of Patent: Aug. 14, 2001

(54) EDGE-FORMING DEVICE FOR A SCREED ASSEMBLY

(75) Inventor: David B. Johanpeter, Mattoon, IL (US)

(73) Assignee: Blaw-Knox Construction Equipment Corporation, Mattoon, IL (US)

( * ) Notice: Subject to any disclaimer, the term of this patent is extended or adjusted under 35 U.S.C. 154(b) by 0 days.

(21) Appl. No.: 09/415,512

(22) Filed: Oct. 8, 1999

(51) Int. Cl.[7] ..... E01C 19/00
(52) U.S. Cl. ..... 404/104; 404/96; 404/118
(58) Field of Search ..... 404/104, 118, 404/96, 98; 172/692, 694, 684.5, 695, 786, 787, 795

(56) References Cited

U.S. PATENT DOCUMENTS

| | | | | |
|---|---|---|---|---|
| 3,680,451 | * | 8/1972 | Birtchet | 94/45 |
| 3,936,211 | * | 2/1976 | Miller et al. | 404/104 |
| 4,093,410 | * | 6/1978 | Miller | 404/104 |
| 4,379,653 | * | 4/1983 | Brown | 404/118 |
| 4,818,140 | * | 4/1989 | Carlson | 404/118 |
| 4,900,185 | * | 2/1990 | Foertsch | 404/104 |
| 5,924,819 | * | 7/1999 | Breidenbach | 404/96 |

* cited by examiner

*Primary Examiner*—Thomas B. Will
*Assistant Examiner*—Raymond W Addie
(74) *Attorney, Agent, or Firm*—Michael Best & Friedrich LLP

(57) ABSTRACT

An edge-forming device is used with a screed assembly having lateral ends and a screed plate extending between the lateral ends, the screed plate having a generally horizontal working surface, and a generally horizontal centerline. The edge-forming device includes a frame connected with a lateral end of the screed assembly and a plate disposed below the frame. The plate has a horizontal working surface and extends outwardly beyond the screed assembly lateral end. An adjustment mechanism is connected with the frame and with the edge-forming plate and displaces the plate with respect to the frame to adjust a vertical position of the edge-forming plate with respect to the screed plate such that the plate forms a vertical step in a mat of material paved by the screed assembly proximal to an edge of the mat. The adjustment mechanism also pivots the plate to adjust the taper angle of the vertical step in the mat and also to adjust the angle of attack of the plate. The adjustment mechanism includes a bracket attached to the frame and a pair of movable supports connected with the bracket and displaceable vertically with respect to the frame. Four connective members, preferably turnbuckles, each have a first end connected with one of the supports and a second end connected with the edge-forming plate. The second ends are displaceable vertically with respect to the supports to displace to the attached portions of the plate.

15 Claims, 7 Drawing Sheets

1
2
3
4
5
6
7
8
9
10
12
14
15
16
M
S
T
E

EDGE-FORMING DEVICE FOR A SCREED ASSEMBLY

BACKGROUND OF THE INVENTION

The present invention relates to paving machines, and more particularly to paving screed assemblies for paving machines.

Screed assemblies used with paving machines to level paving material, typically asphalt, applied by the machine onto a generally horizontal base surface, such as a road bed, are well known. A screed assembly often includes both a main screed and one or more screed extensions connected with the main screed. The screed extension may either be fixedly attached (e.g., bolted) to a lateral end of the main screed (or an outer end of another screed extension) or movably attached to the main screed.

In general, a typical screed assembly levels the paving material into a mat having the general form of an elongated strip. When it is desired to pave a mat of material having a width that exceeds the maximum width of the screed assembly, the paving machine must typically pave two or more parallel mat strips to achieve the desired overall mat width. Each of these mat strips has a longitudinally-extending side edge that must either abut or overlap the proximal edge of the adjacent mat strip so that a continuous surface is formed across the overall width of the mat of material. It is preferred to closely abut the edges of the adjacent mat strips such that, after a subsequent compacting or rolling operation, an integral zone of paving material, referred to as a "joint", exists at the intersection of the adjacent mat strips.

However, if the subsequently paved or "second" mat strip is not carefully applied, one of two adverse conditions may be created at the intersection of the adjacent mat strips. If the second mat strip overlaps the other or "first" strip by a more than certain distance, an upraised section or bump is created at the joint, which may not be eliminated by a subsequent rolling operation. If the second mat strip is applied such that the proximal edges of the first and second mat strips are spaced apart by more than a minimal distance, a gap is created between the mat strips that cannot be eliminated by a rolling operation. In this situation, a subsequent operation to fill the gap with paving material is necessary, creating a weakened zone in the mat of material. Typically, this weakened zone of a material mat will be the first section of the mat that fails (i.e., cracks or crumbles) after a period of use.

In order to eliminate the occurrence of the adverse mat conditions described above, it is known to form a downward step at the edge of the first mat strip and then to pave the second mat strip such that the proximal edge of the second strip overlaps this stepped edge. The joint formed by this procedure is relatively strong and level. Devices for forming the edges of a mat strip to create stepped edges are known. These devices typically have a frame that attaches to a screed assembly and an edge-forming plate connected to the frame. The forming plate is located vertically lower than the screed plate(s) of the screed assembly and may be also be angled so as to create a downwardly-tapered step. However, these known devices generally have minimal or no capability to adjust the vertical height, taper angle and/or angle of attack of the forming plate with respect to the screed plates of the main screed assembly.

It is therefore desirable to provide a device for an edge-forming device for a screed assembly that has a fully adjustable edge-forming plate. Further, it is also desirable to provide such a device that is capable of being connected with existing screed assemblies without the need for any substantial modifications to the existing screed assemblies.

SUMMARY OF THE INVENTION

In a first aspect, the present invention is an edge-forming device for a screed assembly having lateral ends and a screed plate extending between the lateral ends, the screed plate having a generally horizontal working surface. The edge-forming device comprises a frame connected with one of the lateral ends of the screed assembly. A plate is disposed generally below the frame and has a generally horizontal working surface. The plate extends outwardly beyond the one screed assembly lateral end such that the edge-forming plate working surface and the screed plate working surface are spaced horizontally and laterally from each other. An adjustment mechanism is connected with the frame and with the edge-forming plate. The adjustment mechanism is configured to displace the plate with respect to the frame to adjust a vertical position of the edge-forming plate with respect to the screed plate. The edge-forming plate working surface is positionable vertically lower than the screed plate working surface so as to form a vertical step in a mat of material paved by the screed assembly proximal to a lateral edge of the mat.

In another aspect, the present invention is an edge-forming device for use with a screed assembly. The edge-forming device comprises a frame connectable with the screed assembly and a plate disposed generally below the frame. An adjustment mechanism adjustably connects the plate with the frame and includes a base attached to the frame. The adjustment mechanism also includes first and second connective members. Each connective member has a first end connected with the base and a second end connected with the plate. Each second end is vertically displaceable with respect to the base such that displacement of two second ends in a same vertical direction adjusts a vertical position of the plate with respect to the frame. Further, vertical displacement of one second end with respect to the other second end adjusts an angle between the plate and the frame.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
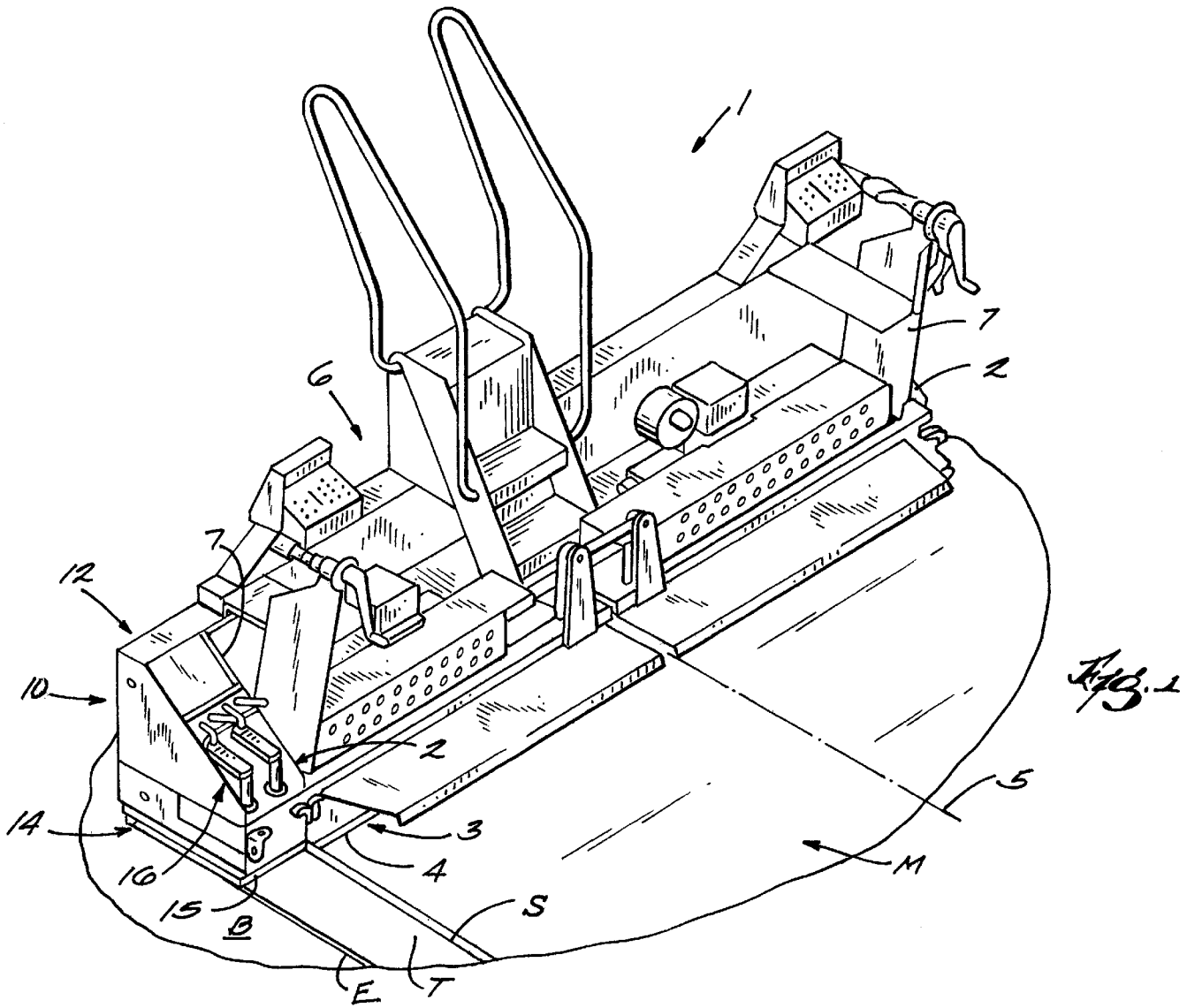
FIG. 1 is a rear perspective view of an edge-forming device in accordance with the present invention, shown attached to a screed assembly.

Certain terminology is used in the following description for convenience only and is not limiting. The words "right", left", "lower", "upper", "upward", "down" and "downward" designate directions in the drawings to which reference is made. The words "front", "frontward" and "rear", "rearward" refer to directions toward and away from, respectively, a designated front section of an edge-forming device, a screed assembly or a specific portion of either, the particular meaning intended being readily apparent from the context of the description. The terminology includes the words specifically mentioned above, derivatives thereof, and words of similar import.

Referring now to the drawings in detail, wherein like numbers are used to indicate like elements throughout, there is shown in FIGS. 1–10 an edge-forming device 10 of the present invention for use with a screed assembly 1. As best shown in FIG. 1, the edge-forming device 10 is preferably used with a screed assembly 1 having lateral ends 2, a screed plate 3 extending between the lateral ends 2 and having a generally horizontal working surface 4, and a generally horizontal centerline 5.

Basically, the edge-forming device 10 comprises a frame 12 which is connectable with either one of the lateral ends 2 of the screed assembly 1. A plate 14 is disposed generally below the frame 12 and has a generally horizontal working surface 15. When the frame 12 is connected with the screed assembly lateral end 2, the plate 14 extends outwardly beyond the lateral end 2 such that the edge-forming plate working surface 15 and the screed plate working surface 4 are spaced horizontally and laterally from each other (i.e., are each disposed on separate sides of the lateral end 2). Further, an adjustment mechanism 16 is connected with the frame 12 and with the edge-forming plate 14. The adjustment mechanism 16 is configured to displace the plate 14 with respect to the frame 12 in order to adjust a vertical position of the edge-forming plate 14 with respect to the screed plate 3.

Figure 9:
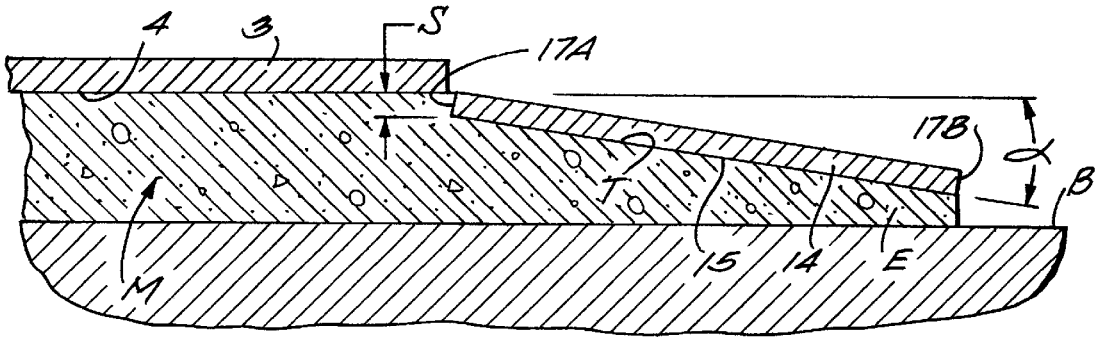
FIG. 9 is a more diagrammatic, rear sectional view of the edge-forming plate and an adjacent portion of a screed plate of the screed assembly, shown in a paving operation.

By using the adjustment mechanism 16, the edge-forming plate working surface 15 is positionable vertically lower than the screed plate working surface 4 so as to form a vertical step S proximal to an edge E of a mat of material M paved by the screed assembly 1, as shown in FIGS. 1 and 9. The adjustment mechanism 16 is also configured to pivot the edge-forming plate 14 alternatively in opposing directions about an axis (not indicated) generally parallel with the screed assembly centerline 5 so as to adjust an angle $\alpha$ (FIG. 9) between the edge-forming plate working surface 15 and the screed plate working surface 4. By positioning the plate working surface 15 at an angle $\alpha$ with respect to the screed plate working surface 4, a downwardly tapered surface T (see FIG. 9) is formed in the material mat M that extends outwardly from the step S to the edge E. Further, the adjustment mechanism 16 is further configured to pivot the edge-forming plate 14 alternatively in opposing directions about an axis (not indicated) generally perpendicular to the screed assembly centerline 5 so as to adjust an angle $\beta$ between the edge-forming plate working surface 15 and the screed plate working surface 4, which provides adjustment of the angle of attack $\delta$ of the edge-forming plate 14 independently of the screed plate 3. Each of the above-described components of the edge-forming device 10, and the operation thereof, is described in greater detail below.

Referring now to FIGS. 1–6, the frame 12 is preferably constructed as an "open-box" housing having a base wall 22, a front wall 24 and two side walls 26 and 27. The base wall 22 is preferably formed as a generally horizontally-extending plate having front and rear downwardly bended sections 22*a* and 22*b*, respectively. The base wall 22 includes at least one and preferably four clearance holes 21 extending through central portions of the plate, the purpose of which are described below.

Preferably, the front wall 24 is formed as a generally vertically-extending plate having a bracket 25 disposed on a rear vertical surface, the purpose of which is described below. The front wall 24 also has a lower portion 24*a* that abuts against and is attached to the front bended section 22*a* of the base wall 22 by appropriate means. Further, each side wall 26, 27 is preferably constructed as a generally triangular-shaped, vertically-extending plate that extends rearwardly from the front wall 24 and along one lateral edge of the base plate 22. Preferably, each side wall 26, 27 has a front vertical edge attached to the front wall 24 and a lower horizontal edge attached to the base wall 22, each edge being attached by appropriate means. Preferably, the attached portions of the four walls 22, 24, 26 and 27 are welded together to form the frame 12, although alternatively the walls 22, 24, 26 and 27 may be connected together by threaded fasteners, rivets, separate brackets or flanges or by any other appropriate means.

Figure 2:
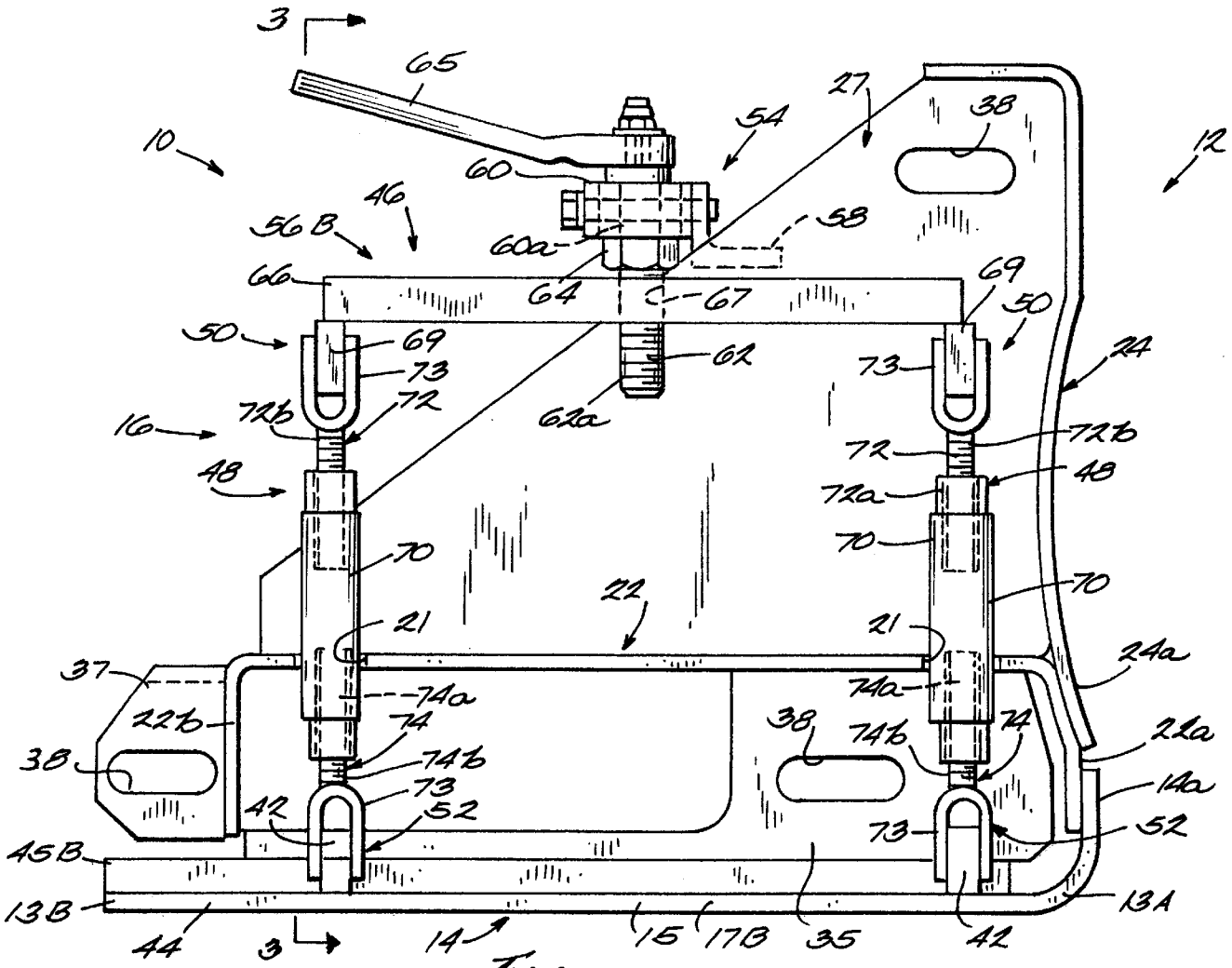
FIG. 2 is a side plan view of the edge forming device.
Figure 6:
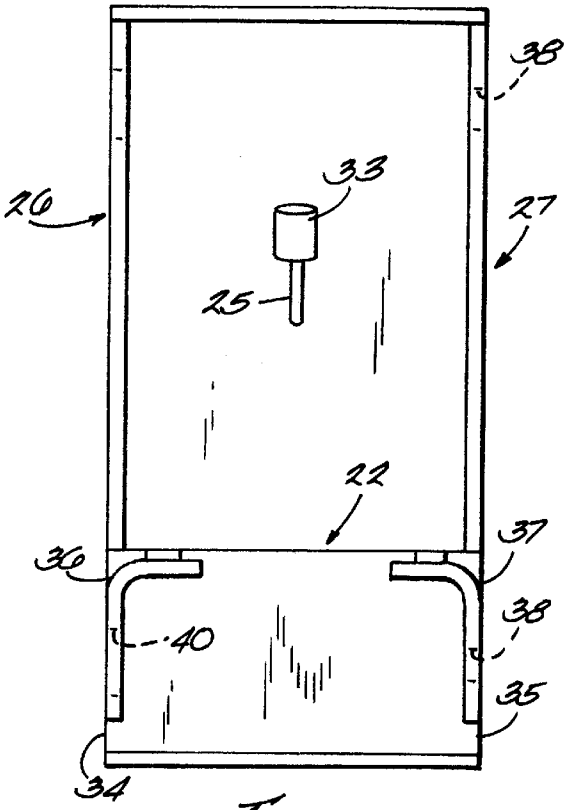
FIG. 6 is rear plan view of the frame.
Figure 5:
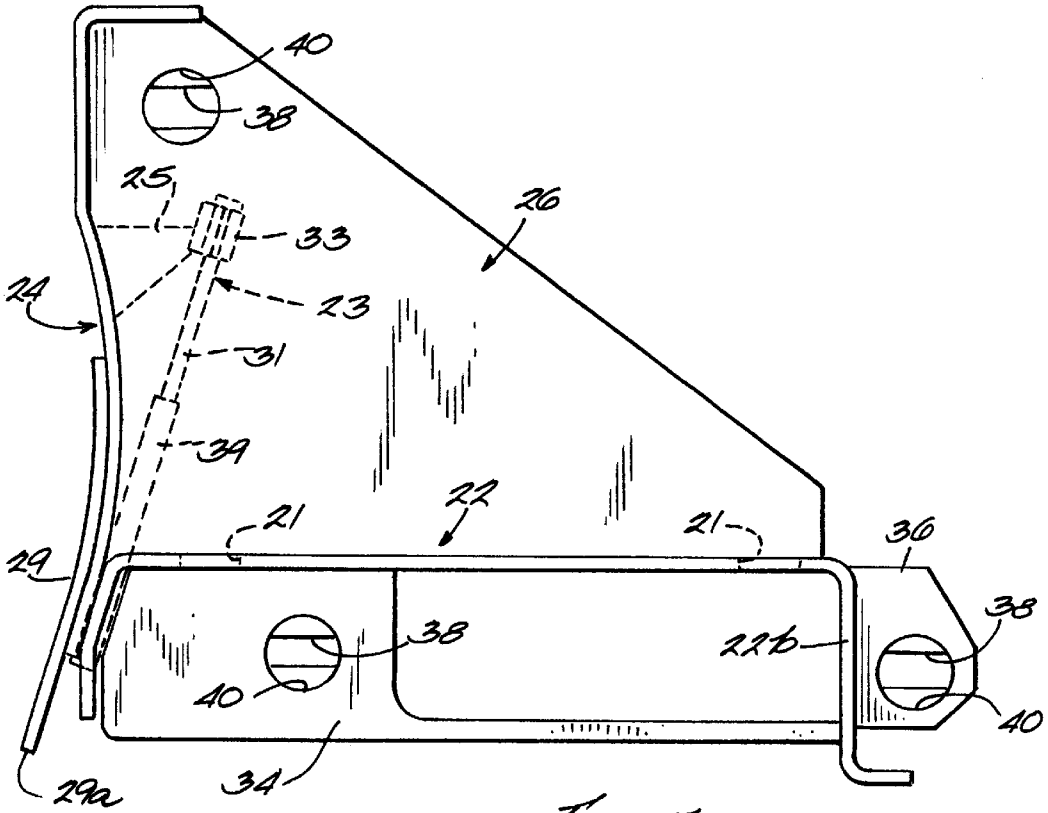
FIG. 5 is a side plan view of a frame of the edge-forming device.

Referring particularly to FIGS. 2, 5 and 6, the frame 12 is preferably provided with components/features for demountably connecting the frame 12 to one of the two lateral ends 2 (only one depicted) of the screed assembly 1, preferably to a lateral side wall 7 of a movable screed extension 6, as shown in FIG. 1. Alternatively, the frame 12 may be connected with a portion of one lateral end 2 of a main screed 8, a fixed screed extension (not shown), or another edge-forming device (not shown).

Preferably, the mounting components include two mounting plates 34, 35, each plate 34 or 35 being attached to a separate lateral edge of the base wall 22 so as to extend vertically downwardly below a proximal one of the side walls 26 and 27, respectively. The mounting plates 34, 35 also increase the rigidity of the frame 12, particularly of the base wall 22. Further, two "L-shaped" mounting brackets 36, 37 are each attached to the rear downwardly bended section 22*b* of the base wall 22, proximal to a separate lateral edge thereof, so as to extend rearwardly from the frame 12.

Further, the frame 12 is preferably configured to connect the edge-forming device 10 alternatively to either the left or the right lateral end 2 of a preferred screed assembly 1. The preferred screed assembly 1 has a pattern of three threaded holes (not shown) on a vertical wall 7 at the left lateral end 2 and a pattern of three slotted openings (not shown) in a vertical wall at 7 the right lateral end 2. Preferably, three slotted openings 38 are provided on the right side of the frame 12, as best shown in FIG. 2, and three threaded holes 40 are provided on the left side of the frame 12 (FIG. 5), each opening 38 being generally aligned with an opposing threaded hole 40.

To connect the device 10 with the left end 2 of the screed assembly 1, the right side wall 27 of the frame 12 is disposed against the left vertical wall 7 of the screed assembly 1 such that the slotted openings 38 in the frame 12 align with the threaded holes (not shown) of the screed assembly 1. Alternatively, to connect the device 10 with the right end 2 of the screed assembly 1, the left side wall 26 of the frame 12 is disposed against the right vertical wall 7 of the screed assembly 1 such that the threaded holes 40 of the frame 12 align with the slotted openings (not shown) of the screed assembly 1. In either mounting configuration, three mandrels (none shown) are each threaded into each hole 40 and inserted through the aligned opening 38, and then a wedge-shaped key (not shown) is inserted into each mandrel, such that the frame 12 is thereby demountably connected with the screed assembly 1.

Further, another edge-forming device (not shown) may be mounted to the first device 10 by means of mandrels inserted through three pairs of aligned openings 38 and threaded holes 40 in a similar manner as that described above. However, it is within the scope of the present invention to use any other means to demountably attach the frame 12 with the screed assembly, such as by threaded fasteners, to fixedly attach the frame 12 to the screed assembly 1, for example by rivets or welding and/or to configure the frame 12 to be alternatively connectable with both lateral ends 2 of the screed assembly 1.

Referring specifically now to FIG. 5, the frame 12 preferably further includes an adjustable strike-off plate 29 mounted to the front surface of the front wall 24. The strike-off plate 29 has a strike-off edge 29*a* that is height adjustable by means of an adjusting assembly 31. The adjustment assembly 31 includes a threaded rod 39 rotatably disposed within a bearing 33 connected to the front wall 24 by the bracket 25. The lower end of the rod 31 threadably engages the upper end of a movable adjustment rod 39 having a lower end attached to the plate 29, such that rotation of the threaded rod 31 vertically displaces the strike-off plate 29.

Preferably, each of the four walls 22, 24, 26 and 27 of the frame 12 are stamped from low carbon steel. Alternatively, the frame 12 and any portion thereof may be fabricated of any other appropriate material using another appropriate manufacturing process, such for example, forming the walls 22, 24, 26 and/or 27 of stamped alloy steel or casting the entire frame 12 from aluminum.

Furthermore, although the frame 12 is preferably formed as an open housing as described above, the frame 12 may be constructed in any appropriate manner that enables the edge-forming device 10 to be connected with a screed assembly 1 and which provides support for the adjustment mechanism 16 and the plate 14. For example, the frame 12 may alternatively be constructed as a generally enclosed housing of any appropriate shape, as a single platform, plate, beam or bar, or as a frame formed of a plurality of structural beams. Further for example, the edge-forming device 10 may be integrally constructed with the main screed 6 or with an extendible screed (not shown), such that the frame 12 of the device 10 is provided by integral portions of the screed assembly 1 and not by a separate frame. The present invention is not limited to any single configuration of the frame 12 and embraces all appropriate, alternative constructions thereof that enable the edge-forming device 10 to function as described above and in further detail below.

Figure 7:
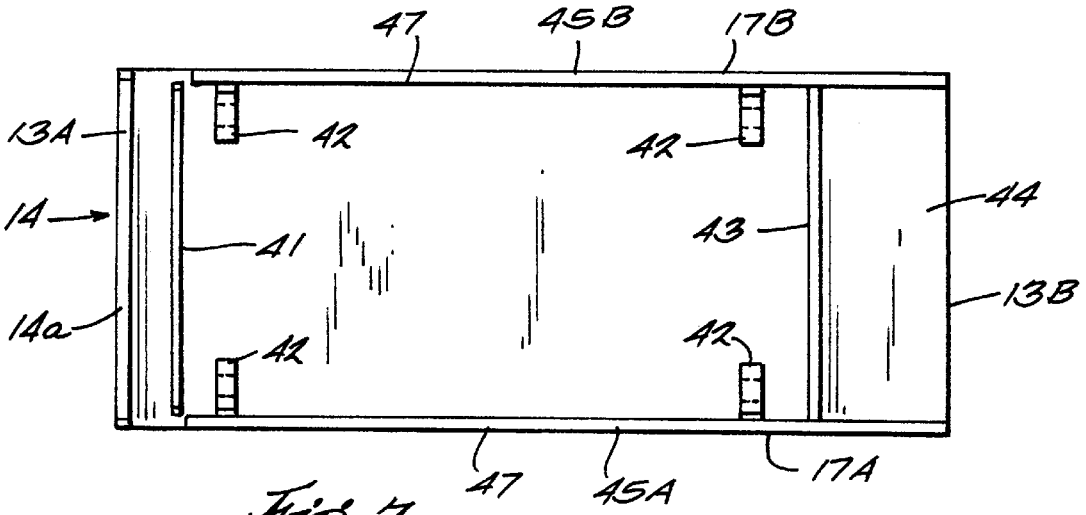
FIG. 7 is top view of the edge-forming plate.
Figure 8:
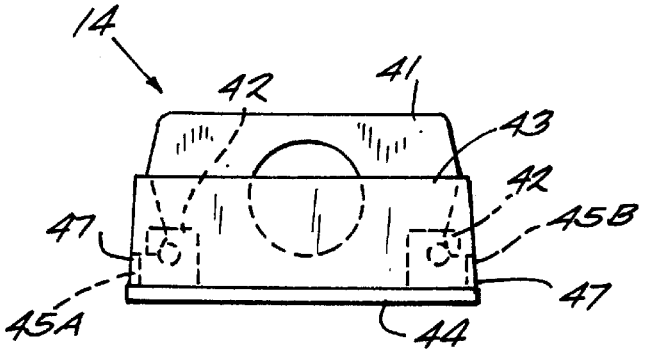
FIG. 8 is a rear plan view of the plate.

Referring now to FIGS. 2, 7 and 8, the edge-forming plate 14 is primarily formed of a generally rectangular plate of material 44 having a lower surface providing the edge-forming working surface 15. Further, the edge-forming plate 14 preferably has an upwardly-bended section 14*a* at the front end of the plate 44 that provides a surface to channel or direct paving material to the lower working surface 15. As shown in FIGS. 7 and 8, the edge-forming plate 14 preferably includes front and rear vertical spacer walls 41 and 43, respectively, attached to the upper surface of the plate 44 so as extend horizontally and laterally across the plate 44. The spacer walls 41, 43 act to position the plate 14 with respect to the frame 12, specifically so as to be generally centered beneath the base wall 22.

Preferably, the edge-forming plate 14 further includes two vertical side walls 45A, 45B extending upwardly from the plate 44 and along the lateral edges thereof. The side walls 45A, 45B act to position the plate 14 with respect to the frame 12 and to prevent paving material from accumulating on the upper surface of the plate 14. Further, the side walls 45A, 45B also provide vertical surfaces 47 for forming vertical portions of a step S in a mat of material M, as discussed above and in further detail below.

Furthermore, the edge-forming plate 14 also preferably includes at least one and most preferably four mounting lugs 42 disposed on the upper surface of the plate 44 at spaced-apart locations. The lugs 42 are configured to attach the plate 14 to portions of the adjustment mechanism 16 in order to movably connect the plate 14 with the frame 12, as described below. However, the plate 14 may alternatively be provided with any other appropriate means to enable the plate 14 to be connected with the adjustment mechanism 16, such as for example, threaded holes, through-holes, attachment nuts or brackets (none shown).

Preferably, the edge-forming plate 14 is stamped (i.e., formed or bended) from high carbon steel, the spacer walls 41, 43 and side walls 45A, 45B are machined from low carbon steel bar stock and the lugs 42 are machined from high carbon or alloy steel. However, each of the components of the edge-forming plate 14 may be formed of any appropriate material and by any appropriate manufacturing process. Further, although the plate 14 is preferably constructed as described above and depicted in the drawings, it is within the scope of the present invention to construct the plate 14 in any appropriate manner that enables the edge-forming device 10 to function as described above and in further detail below. For example, the plate 14 may be formed without an upwardly bended section, spacer walls and/or side walls, may be configured as a relatively thick block (not preferred) and/or may have portions directly and movably connected with the frame 12, as opposed to being connected therewith only through the adjustment mechanism 16. The scope of the present invention includes these and all other appropriate configurations of the edge-forming plate 14.

Figure 3:
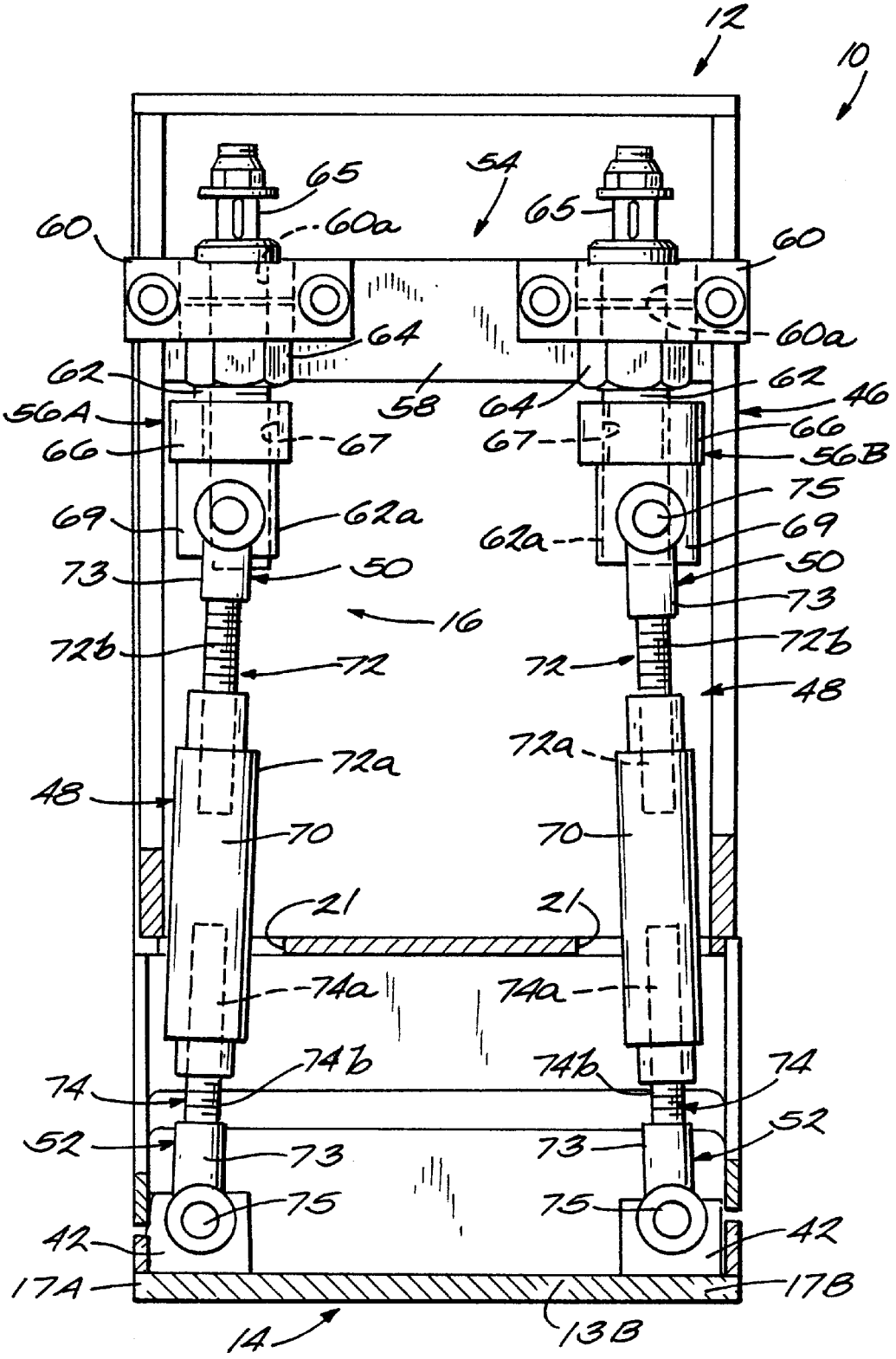
FIG. 3 is a rear, sectional view of the edge-forming device taken along line 3—3 of FIG. 2.
Figure 4:
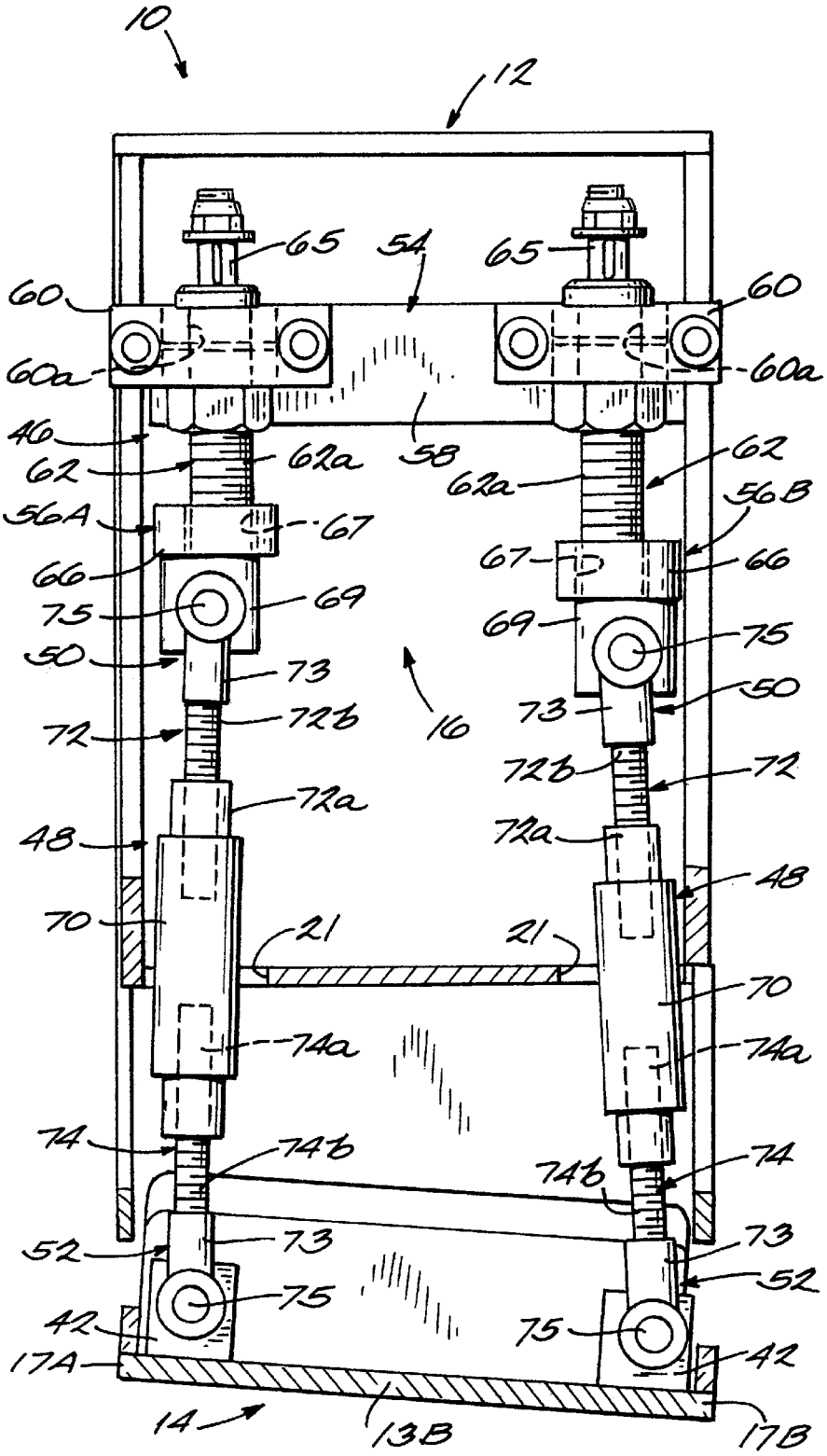
FIG. 4 is another rear view of the edge-forming device shown in FIG. 3, depicting an edge-forming plate in a second position.

Referring now to FIGS. 2–4, the adjustment mechanism 16 primarily comprises a base 46 attached to the frame 12 and at least one connective member, and preferably four connective members 48 extending between the base 46 and the edge-forming plate 14. Preferably, four connective members 48 are arranged such that each member 48 is generally located at a separate corner of a rectangle, i.e., two pairs of connective members 48 are spaced from each other horizontally in the lateral direction, as indicated by FIGS. 3 and 4, and two pairs of connective members 48 are spaced from each other horizontally in the longitudinal direction (i.e., direction generally parallel with the centerline 5), as indicated by FIG. 2. Referring to FIG. 7, the attachment lugs 42 on the edge-forming plate 14 are arranged in accordance with the preferred arrangement of the connective members 48.

Further, each connective member 48 has a first end 50 connected with the base 46 and a second end 52 connected with the edge-forming plate 14. The second end 52 of each connective member 48 is displaceable vertically with respect to the base 46 so as to displace an attached portion of the edge-forming plate 14 vertically with respect to the screed plate 3. Further, the vertical displacement of at least one connective member second end 52 with respect to the other connective member second ends 52 adjusts one or more angles between the edge-forming plate 14 and the screed plate(s) 3, as discussed in further detail below.

Describing now in detail the components of the adjustment mechanism 16, the base 46 preferably comprises a bracket 54 attached to the frame 12 and at least one and preferably two movable supports 56A, 56B connected with the bracket 54. The bracket 54 includes an angled (i.e., with an L-shaped cross section) bar 58 extending horizontally and laterally between the two side walls 26, 27 of the frame 12. The ends of the bar 58 are attached to the proximal wall 26 or 27 by appropriate means, such as by welding, to connect the base 46, and thus the adjustment mechanism 16, with the frame 12. Further, the bracket 54 includes a pair of bearing blocks 60 attached to a vertically-extending leg of the angled bar 58, preferably by means of threaded fasteners.

The base 46 preferably further includes two vertically-extending adjusting rods 62. Each rod 62 extends through a bearing hole 60*a* in a separate one of the blocks 60 and has a lower end connected with a separate one of the movable supports 56A, 56B, as described below. Preferably, a jam nut 64 is provided on each rod 62 such that the rods 62 are rotatable, but not displaceable, with respect to the bracket 54. Further, a handle 65 is attached to the upper end of each adjusting rod 62 to enable manual rotation of the rods 62. Alternatively, the adjusting rods 62 may be automatically driven and provided with the necessary components for automatic operation. For example, a sprocket may be attached to the rod 62 and may be engaged by a chain driven by a motor mounted on another portion of the base 46 or the frame 12 (structure not depicted).

As best shown in FIG. 2, the movable supports 56A, 56B are each preferably constructed as a generally rectangular bar 66 that extends horizontally in a longitudinal direction (i.e., front-to-rear). The bars 66 of the two movable supports 56A, 56B are disposed beneath the bracket 46 and are spaced horizontally and laterally from each other. Each bar 66 includes a threaded opening 67 which is configured to be threadably engaged with a lower, threaded portion 62*a* of a separate one of the adjusting rods 62. Further, each movable support 56A, 56B includes two attachment lugs 69, each lug 69 being disposed proximal to a separate end of the bar 66 and configured for attachment of the one of the connective members 48, as discussed below.

With the above-described structure, the movable supports 56A, 56B are each vertically displaceable by rotating the connected adjusting rod 62 within the associated bearing block 60. Due to the engagement of the threaded opening 67 with the threaded rod portion 62*a*, the support member bar 66 travels along the rod threads to move alternatively upward and/or downward with respect to the base 46 (and thus the frame 12), depending on the direction of rotation of the associated rod 66. By having two adjusting rods 62 and two bars 66, the two movable supports 56A, 56B are vertically adjustable independently of each other, so as to provide an additional method of displacing the second ends 52 of the connective members 48, and thus the edge-forming plate 14, as discussed below.

Although the base 46 preferably includes two movable supports 56 constructed as described above, it is within the scope of the present invention to construct the base 46 with only a single movable support 56A or 56B, as described above, with the adjustment mechanism 16 having only two connective members 48. As a further alternative, the base 46 may include a single movable support 56 constructed, for example, as a plate, a block or a frame of interconnected members (none shown), with the adjustment mechanism 16 having one, three, four or any desired number of connective members 48 attached to the movable support 56. Therefore, the present invention includes all appropriate configurations of the movable support(s) 56A, 56B which enable the adjustment mechanism 16 to function generally as described herein.

Further, it is also within the scope of the present invention to construct the base 46 without any movable supports, such that the edge-forming plate 14 is displaced solely by movement of the connective member(s) 48. Such a configuration of the base 46 may constructed without bearing blocks 60 or adjusting rods 62 and may include one or more other component(s), for example a plate(s), block(s) or a frame (none shown) attached to the bracket 54, with the connective members 48 being attached to such other component(s). Furthermore, the base 46 may be configured to comprise only a single member, such as a modified bracket (not shown), attached to the frame 12 with the connective members 48 being directly attached to this member.

Referring again to FIGS. 2–4, each connective member 48 is preferably configured as a conventional turnbuckle that extends between the base 46 and the plate 14 through a separate opening 21 in the base wall 22. Each connective member 48 includes a central, rotatable buckle portion 70 and upper and lower threaded rods 72, 74, respectively. The rods 72, 74 each have an inner threaded end 72*a*, 74*a*, respectively, that is threadably engaged with a separate threaded opening 70*a* in the central buckle 70. The threads of the two openings 70*a* of the buckle 70 are oppositely-directed, i.e., one opening 70*a* has a right-hand thread and the other opening 70*a* has a left-hand thread. Therefore, rotation of the buckle 70 in a first direction causes the two rods 72, 74 to move toward the buckle 70 and rotation in a second, opposing direction causes the rods 72, 74 to move away from the buckle 70, so as to alternatively displace the second end 52 of the particular connective member 48, as discussed below.

Further, the upper rod 72 of each connective member 48 has an outer end 72*b* which provides the first end 50 of the connective member 48 and the lower rod 74 has an outer end 74 *b* that provides the second end 52 of the connective member 48. Preferably, a separate yoke or clevis 73 is mounted at each outer end 72*b*, 74*b* of the upper and lower rods 72, 74, respectively. The clevis 73 at the connective member first end 50 is connected with one of the attachment lugs 69 of the associated movable support 56, preferably by means of a pin 75, to thereby connect the connective member 48 with the base 46. Further, the clevis 73 at the connective member second end 52 is connected with one of the attachment lugs 42 on the edge-forming plate 14, also by means of a pin 75, to connect the particular connective member 48 with the edge-forming plate 14.

By having the clevis-lug connections, the connective members 48 are each capable of a degree of pivotal movement at both the first and second ends 50, 52. The pivotal movement provided by the clevis-lug connections enables the adjustment of a single connective member 48 to vertically displace the edge-forming plate 14, as discussed below, which may otherwise be prevented by having a structure with four relatively rigid members 48.

Each of the preferred connective members 48 functions, i.e., to vertically displace an attached portion of the edge-forming plate 14, in the following manner. By rotating the buckle 70 in a first direction, the two rods 72, 74 displace toward each other. As the connective member first end 50 is preferably attached to one of the movable supports 56A, 56B, such that the connective member 48 is suspended from the support 56A or 56B, the displacement of the two rods 72, 74 toward each other causes the connective member second end 52 to displace vertically upward toward the base 46. The upward displacement of the connective member second end 52 causes the portion of the plate 14 that is attached to the second end 52 to displace vertically upward.

Further, rotating the buckle 70 in a second, opposing direction causes the two rods 72, 74 to move away from each other, such that the connective member second end 52 displaces vertically downward and away from the base 46. The downward movement of the connective member second end 52 causes the attached portion of the plate 14 to displace vertically downward. Each of the connective members 48 may be independently adjusted, in the manner described above, alternatively in either direction (i.e., vertically upward and/or downward). Thus, the edge-forming plate 14 is adjustable at four separate or independent points, i.e., the points of attachment of the connective member second ends 52, as discussed further below.

Although the connective members 48 are preferably configured as turnbuckles, the members 48 may be constructed in any other appropriate structure having a first end connected with the base and a second end connected with the plate, with the second end being displaceable with respect to the base. For example, each connective member 48 may alternatively be constructed as a one-piece rod (not shown) having an upper end connected with the base 46 and a lower end connected with the plate 14, with a threaded portion at one end of the rod being threadably engaged with either the plate 14 or the base 46. With this alternative construction, rotation of the rod causes movement along the threads of the rod, either vertical movement of the plate 14 with respect to the rod or of both the rod and the plate 14 with respect to the base 46.

As another alternative, each connective member 48 may be constructed as a hydraulic cylinder actuator (not shown), with the cylinder and the piston rod each being connected with a separate one of the base 46 and the plate 14. With the connective members 48 configured as hydraulic cylinders, the extension and retraction of the piston rod causes the end of the actuator that is attached to the plate 14 (i.e., the second end 52), and thus the plate 14, to displace vertically downwardly and upwardly, respectively. As yet another example, each connective member 48 may be constructed as a rack gear (not shown) extending between the base 46 and the plate 14 that is engaged with a pinion (not shown) mounted on either the base 46 or the plate 14, such that rotation of the pinion vertically displaces the rack to vertically displace the plate 14.

Furthermore, the adjustment mechanism 16 may be provided with only two connective members 48, a first connective member 48 and a second connective member 48, spaced horizontally and laterally with respect to each other such that the second end 52 of each member 48 is attached to the plate 14 proximal to a separate one of the lateral sides 17A, 17B thereof. Such a configuration is similar to the structure shown in FIGS. 3 and 4, which each depicts only the two rearwardly disposed connective members 48, and may be achieved by modifying the preferred structure to eliminate one of the two pairs of laterally spaced connective members 48. With such an alternative configuration, the vertical position and the angle $\alpha$ for the plate 14 are adjustable, but not the angle $\beta$. All of the above-described alternatives are only examples of possible configurations of the connective members 48, and the edge-forming device 10 of present invention is not limited having connective members 48 with any one of the specific structures described herein. It is therefore within the scope of the present invention to construct any or all of the connective members 48 in any appropriate manner that enables the edge-forming device 10 to generally function as described above and in further detail below.

Referring now to FIGS. 1–4, 9 and 10, the edge-forming device 10 of the present invention is basically used or operated in the following manner. When connected with a lateral end 2 of a screed assembly 1, as depicted in FIG. 1, the edge-forming plate 14 extends horizontally and laterally beyond the other "screeding" portions of the screed assembly 1, either of the main screed plate alone (if no screed extensions) (e.g, FIG. 1) or both the main and extension screed plates (if any screed extensions form part of the screed assembly). Being so located, the edge-forming plate 14 is capable of leveling or paving the lateral edge E of a mat of material M independently of the action of the inwardly disposed screed plates 3.

Figure 10:
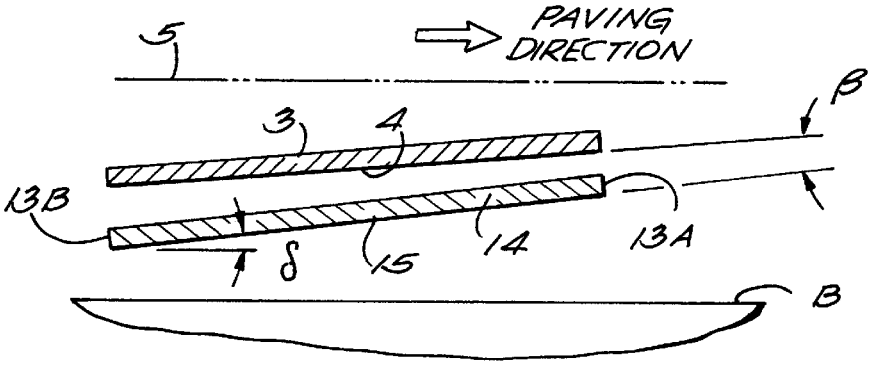
FIG. 10 is a more diagrammatic, side sectional view of the edge-forming plate and an adjacent screed plate.

As diagrammatically depicted in FIGS. 9 and 10, the adjustment mechanism 16 may be used to position the edge-forming plate 14 vertically lower than the screed plate(s) 3 of the screed assembly 1. Such positioning of the plate 14 locates or positions the edge-forming working surface 15 vertically lower than the screed plate working surface 4. As shown in FIG. 9, when the plate working surface 15 is located vertically lower than the screed working surface 4, the edge-forming device 10 forms a vertical step S at the lateral or side edge E of the mat of material M as the screed assembly 1 levels or forms the remaining sections of the mat M.

To adjust the vertical height of the step S, the turnbuckles 70 of the four connective members 48 may be rotated such that the connective member second ends 52 of all four members 48 are each displaced by substantially the same distance in the same direction. Such vertical displacement of the ends 52 causes the attached edge-forming plate 14 to vertically displace by the particular distance without varying the angles $\alpha$ and $\beta$. With the preferred construction of the mechanism 16 having two movable supports 56A, 56B, the two supports 56A and 56B may be vertically displaced by substantially the same distance in the same direction to vertically displace the plate 14 without varying the angles $\alpha$ and $\beta$.

Further, the adjustment mechanism 16 may also be used to pivot the edge-forming plate 14 to adjust the angle a between the edge-forming plate working surface 15 and the screed plate working surface 15 by a desired amount. The adjustment mechanism 16 is capable of adjusting the angle $\alpha$ due to the arrangement of at least two connective members 48, and preferably two pairs of members 48, being spaced apart horizontally in the lateral direction. Thus, at least one and preferably two connective member second ends 52 are attached proximal to the left lateral side 17B of the plate 14, and at least one and preferably two ends 52 are attached proximal to the right lateral side 17B of the plate 14, as indicated by in FIGS. 3 and 4. Adjusting the angle $\beta$ varies the angle of the tapered surface T formed by the edge-forming device 10 during a paving operation.

To vary or adjust the angle a (FIG. 9) between the working surfaces 5 and 15 (as discussed above), the pair of connective member second ends 52 attached to the plate 14 proximal to one lateral side 17A or 17B thereof are vertically displaced with respect to the two second ends 52 attached proximal to the other plate side 17B, 17A. Such relative displacement between the two pairs of connective member second ends 52 causes the attached plate 14 to pivot or rotate in a lateral direction about an axis (not indicated) parallel with the screed centerline 5. The pair of second ends 52 attached to one side (e.g., 17B) of the plate 14 are vertically displaced with respect to the pair of second ends 52 attached to the other side (i.e., 17A) by one of two methods. Either the turnbuckles 70 of at least one pair of the connective members 48 are rotated (i.e., in the same direction) or one of the movable supports 56A or 56B is vertically displaced with respect to the other movable support 56B, 56A, as depicted in FIG. 4.

Referring to FIGS. 2 and 10, the adjustment mechanism 16 may be used to adjust the angle β between the working surfaces 4 and 15 in order to vary the angle of attack δ of the edge-forming device 10 independently of the angle of attack of the screed assembly 1. The adjustment mechanism 16 is capable of adjusting the angle of attack δ due to the arrangement of at least two connective members 48 being spaced apart horizontally in the longitudinal direction. Thus, at least one and preferably two connective member second ends 52 are attached proximal to the front end 13A of the plate 14 and at least one and preferably two second ends 52 are attached proximal to the rear end 13B of the plate 14, as best indicated by FIG. 2

More specifically, to vary or adjust the angle δ, the pair of connective member second ends 52 attached to the plate 14 proximal to either the front or rear ends 13A, 13B, respectively, of the plate 14 are vertically displaced with respect to the pair of second ends 52 attached proximal to the other end 13B, 13A. Such relative displacement between the connective member second ends 52 causes the attached plate 14 to pivot or rotate in a longitudinal direction about an axis (not shown) perpendicular to the screed centerline 5. The pair of second ends 52 connected to one end (e.g., 13B) of the plate 14 are displaced with respect to the pair of ends 52 attached to the other end (i.e., 13A) by rotating the turnbuckles 70 of at least one pair of the front and rear pairs of connective members 48.

Generally, the edge-forming device 10 is used to form a stepped and tapered edge E in a mat of material M paved by the screed assembly 1. However, if no step and/or taper is desired to be formed at certain edge sections of a mat M, the adjustment mechanism 16 may be used to vertically displace the edge-forming plate 14 so that the plate 14 is substantially at the same vertical height as, and parallel with, the screed plate(s) 3. Further, the edge-forming device 10 may be used to form a tapered edge (not shown) having no step by positioning the side 17A or 17B that is proximal to the screed plate 3 to be at substantially the same vertical height as the screed plate 3 and displacing the other side 17B, 17A vertically downward to establish a desired angle α.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An edge-forming device for a screed assembly having lateral ends and a screed plate extending between the lateral ends, the screed plate having a generally horizontal working surface, the edge-forming device comprising:

a frame connected with one of the lateral ends of the screed assembly;

a plate disposed generally below the frame, having a generally horizontal working surface and extending outwardly beyond the screed assembly lateral end such that the edge-forming plate working surface and the screed plate working surface are spaced laterally from each other; and an adjustment mechanism connected with the frame and with the edge-forming plate, the adjustment mechanism including first and second movable supports that are spaced horizontally from one another, first and second connective members each being connected at a first end to the first movable support and at a second end to the plate, each second end of the first and second connective members being displaceable vertically with respect to the first movable support such that displacement of the first connective member second end with respect to the second connective member second end adjusts an angle between the edge-forming plate and the screed plate, third and fourth connective members each being connected at a first end to the second movable support and at a second end to the plate, each second end of the first and second connective members being displaceable vertically with respect to the second movable support such that displacement of the third connective member second end with respect to the fourth connective member second end adjusts an angle between the edge-forming plate and the screed plate, the adjustment mechanism being configured to displace the plate with respect to the frame to adjust a vertical position of the edge-forming plate with respect to the screed plate such that the edge-forming plate can be positioned vertically lower than the screed plate so as to form a vertical step in a mat of material paved by the screed assembly proximal to an edge of the mat.

2. The edge-forming device as recited in claim 1 wherein the screed assembly further includes a generally horizontal centerline and the adjustment mechanism is configured to pivot the edge-forming plate alternatively in opposing directions about an axis generally parallel with the centerline of the screed assembly so as to adjust an angle between the edge-forming plate working surface and the screed plate working surface, the edge-forming plate being positionable to form a downwardly tapered surface on the mat of material extending from the step to the lateral edge.

3. The edge-forming device as recited in claim 1 wherein the screed assembly further includes a generally horizontal centerline and the adjustment mechanism is configured to pivot the edge-forming plate alternatively in opposing directions about an axis generally perpendicular to the screed assembly centerline so as to adjust an angle between the edge-forming plate working surface and the screed plate working surface to adjust an angle of attack of the edge-forming plate working surface.

4. The edge-forming device as recited in claim 1 further comprising a base connected with the frame and the first and second movable supports, the base being displaceable vertically with respect to the frame so as to displace the edge-forming plate vertically with respect to the screed plate.

5. The screed assembly as recited in claim 4 wherein at least one of the connective members is a turnbuckle.

6. The edge-forming device as recited in claim 1 wherein vertical displacement of the movable supports adjusts a vertical position of the edge-forming plate with respect to the screed plate.

7. The edge-forming device as recited in claim 1 wherein vertical displacement of the two movable supports in a same direction adjusts a vertical position of the edge-forming plate with respect to the screed plate and vertical displacement of one movable support with respect to the other movable support adjusts one of the angles between the edge-forming plate and the screed plate.

8. An edge-forming device for use with a screed assembly, the edge-forming device comprising:

a frame connectable with the screed assembly, an edge-forming plate disposed generally below the frame; and an adjustment mechanism adjustably connecting the plate with the frame and including:

a base attached to the frame;

first and second connective members spaced apart horizontally from each other, each of the first and second connective members having a first end connected with the base and a second end connected with the edge forming plate, each second end of the first and second connective members being vertically displaceable with respect to the base such that displacement of the two second ends in a same vertical direction adjusts a vertical position of the edge forming plate with respect to the frame and vertical displacement of one second end with respect to the other second end adjusts the orientation of the edge forming plate with respect to the frame; and third and fourth connective members spaced horizontally apart from each other and the first and second connective members, each of the third and fourth connective members having a first end connected with the base and a second end connective with the edge-forming plate, each second end of the first and second connective members being vertically displaceable with respect to the base such that displacement of the two second ends in a same vertical direction adjusts a vertical position of the edge forming plate with respect to the frame and vertical displacement of one second end with respect to the other second end adjusts the orientation of the edge forming plate with respect to the frame.

9. The edge-forming device as recited in claim 8 wherein the base comprised a bracket attached to the frame and is movably supported with respect to the frame.

10. The screed assembly as recited in claim 8 wherein at least one of the connective members is a hydraulic cylinder.

11. The edge-forming device as recited in claim 8 in combination with a screed assembly having two lateral ends, the frame being connected with one lateral end of the screed assembly.

12. The screed assembly as recited in claim 8 wherein vertical displacement of one second end with respect to the other second end on the first and second connective members vertically or angularly adjusts the edge-forming plate with respect to the frame.

13. The screed assembly as recited in claim 12 wherein vertically or angularly adjusting the edge forming plate with respect to the frame includes adjusting an angle from the group comprising crown cross-slope or angle of attack.

14. The screed assembly as recited in claim 8 wherein vertical displacement of one second end with respect to the other second end on the third and fourth connective members vertically or angularly adjusts the edge forming plate with respect to the frame.

15. The screed assembly as recited in claim 14 wherein vertically or angularly adjusting the edge forming plate with respect to the frame includes adjusting an angle from the group comprising crown cross-slope or angle of attack.

* * * * *